US005168611A

United States Patent [19]

Hornung

[11] Patent Number: 5,168,611

[45] Date of Patent: Dec. 8, 1992

[54] AUTOMATED LEAD MAKING MACHINE HAVING DEFECTIVE LEAD REMOVAL

[75] Inventor: Craig W. Hornung, Harrisburg, Pa.

[73] Assignee: AMP Incorporated, Harrisburg, Pa.

[21] Appl. No.: 708,408

[22] Filed: May 30, 1991

[51] Int. Cl.[5] ..... H01R 43/00

[52] U.S. Cl. ..... 29/33 M; 29/564.4; 29/753

[58] Field of Search ..... 29/564.6, 566.3, 749, 29/753, 747, 564.4; 198/351, 362

[56] References Cited

U.S. PATENT DOCUMENTS 4,087,908 5/1978 Fusco et al. ..... 29/753
4,561,155 12/1985 Randar et al. ..... 29/33 M
4,607,554 8/1986 Adlon et al. ..... 83/950 X
4,641,428 2/1987 Anderson ..... 29/564.4 X
4,825,537 5/1989 Berry et al. ..... 29/753 X
5,083,370 1/1992 Koch et al. ..... 29/753 X

*Primary Examiner*—William Briggs

[57] ABSTRACT

The present invention relates to an automated machine for making electrical leads and for automatically identifying and removing leads having defective terminal attachments. A crimp quality monitor device is used to monitor machine performance and to identify defective terminal attachments as they are made. When such a defective attachment is identified, the monitor generates a signal which causes a gate mechanism to route the defective lead to a particular tray. When a lead having a high quality terminal attachment is detected, the lead is routed to another tray so that the non-defective leads are not commingled with the defective leads.

10 Claims, 6 Drawing Sheets

AUTOMATED LEAD MAKING MACHINE HAVING DEFECTIVE LEAD REMOVAL

The present invention relates to automated machines for making electrical leads of the type having a terminal attached to one or both ends.

BACKGROUND OF THE INVENTION

A Widely used type of lead making machine, referred to as an in-line machine, comprises a wire feeding means for feeding wire along a horizontal straight feed path which extends through upstream (relative to the direction of wire feed) and downstream transfer mechanisms and through wire severing blades and insulation cutting blades which are located between the upstream and downstream wire transferring mechanisms. Crimping presses are located adjacent to the wire severing and insulation cutting blades on one side or on both sides of the feed path. In use, the wire is fed through the transferring mechanisms until the desired length for the lead extends from the severing blades beyond the downstream transferring mechanism. The wire severing and insulation cutting blades are then closed and the transferring mechanisms are moved axially away from the blades to strip insulation from the cut ends of the wire, which extends from the wire source, and the trailing end of the lead which extends through the downstream transferring mechanism. The transferring mechanisms are then shifted to present the stripped ends of the wire and lead to the crimping presses at which terminals are crimped onto the stripped ends. The transferring mechanisms are then returned to their aligned positions on the feed path. A completed lead is removed from the downstream transferring mechanism while the wire from the endless source extends from the upstream mechanism and has a terminal crimped onto its end. The process of feeding the wire, closing the cutting and severing blades, etc., is then repeated to produce the next lead in the series. Such a machine is more fully described in copending U.S. patent application serial No. 576,309 which was filed Aug. 31, 1990, and is incorporated by reference as though set forth verbatim herein. Crimping presses, similar to the type used in the lead making machine described above, can be fitted with monitoring equipment for determining the quality of each crimped connection made and identifying those leads having defective terminal attachments. Such an equipped press is disclosed in copending U.S. patent application Ser. No. 529,036 which was filed May 29, 1990 and is incorporated by reference as though set forth verbatim herein. The equipment includes a computer and associated devices for sensing force and ram position so that a work curve can be generated for each crimping operation as the crimped connection is being made. This work curve is then analyzed to determine the quality of the crimped connection with respect to some previously defined standard. However, such an equipped press has not heretofore been coupled to a lead making machine of the type described above to identify those leads having defective terminal attachments and to automatically separate them from leads of acceptable quality during operation of the machine. The present invention addresses such a machine.

SUMMARY OF THE INVENTION

The present invention permits the identifying and segregation of defective leads during the operation of an automated lead making machine. The machine includes means for cutting a lead of desired length from a supply of wire and for preparing the ends of the lead, press means for attaching a terminal to an end of the lead, and monitor means for determining the quality of attachment of the terminal and for identifying a defective attachment. Sorting means is provided that, in response to the monitor, will direct a lead into a first station if defective and into a second station if not defective.

DESCRIPTION OF THE PREFERRED EMBODIMENT

Figure 3:
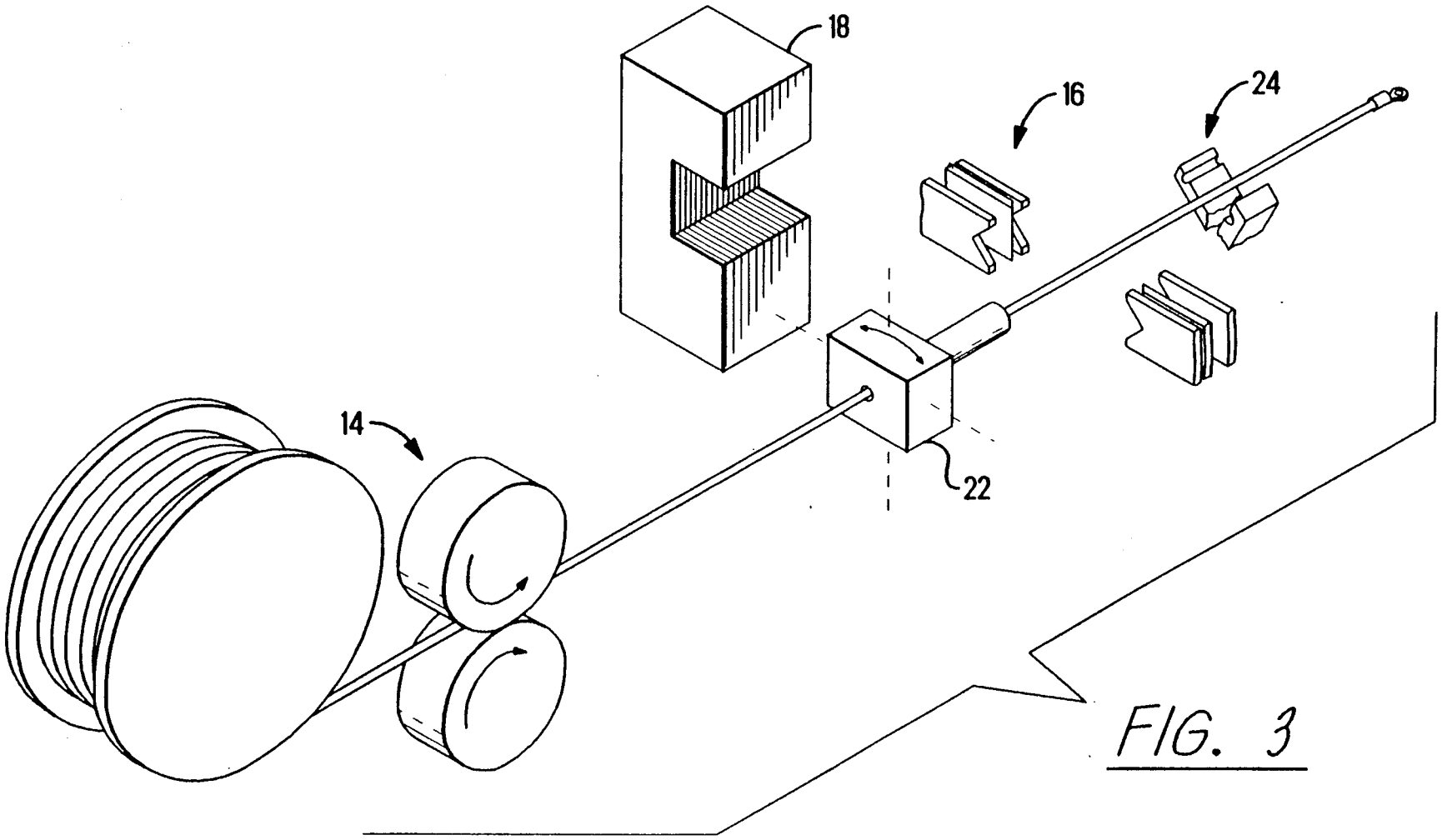
Figure 4:
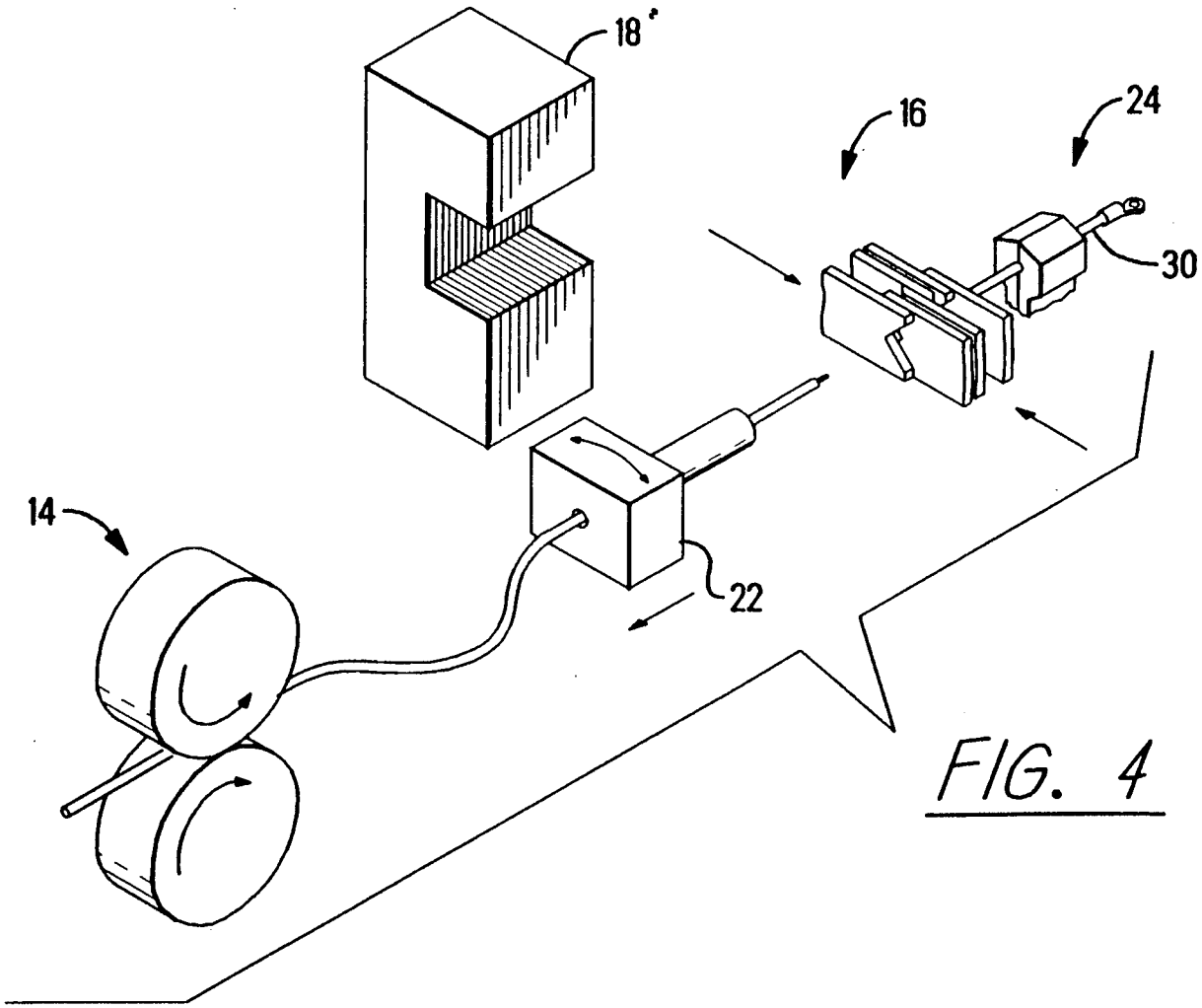

There is shown in FIGS. 1, 2, 3 and 4 an automated lead making machine 10 having a top plate 12, a wire feeding apparatus 14, a wire severing and insulation stripping assembly 16, and a pair of crimping presses 18 and 20, or similar terminal applicators. A wire transfer mechanism 22 receives the wire from the wire feeding apparatus 14, presents the first end, which has been cut and stripped when the previously processed lead was cut, to the press 18 for application of a terminal. The wire transfer mechanism 22 is then brought back into alignment with the severing and stripping assembly 16 and the wire fed to the desired lead length as best seen in FIG. 3. The portion of the wire fed past the severing and stripping assembly 16 is then clamped by a second wire transfer mechanism 24 while the severing and stripping assembly 16 is actuated to cut a lead 30 to length and strip the insulation from the second end of the lead and from the first end of the wire being held by the transfer mechanism 22 as shown in FIG. 4. The wire transfer mechanism 24 then swings counterclockwise to present the second end of the lead 30 to the press 20 for application of a terminal as shown in phantom line in FIG. 1. After the terminal is applied, a wire transport means 32 grips the lead 30 near its second end, the second transfer mechanism 24 releasing the wire, and swings clockwise from a first position shown in phantom lines to a second position shown in solid lines in FIG. 1. The lead is then dropped into a lead stacking tray 34 for later removal by an operator. The control of the machine is effected by a computer. While the above is a very brief description of the major components of an automated lead making machine and its operation, a more detailed description is presented in the above mentioned '309 patent application.

Figure 1:
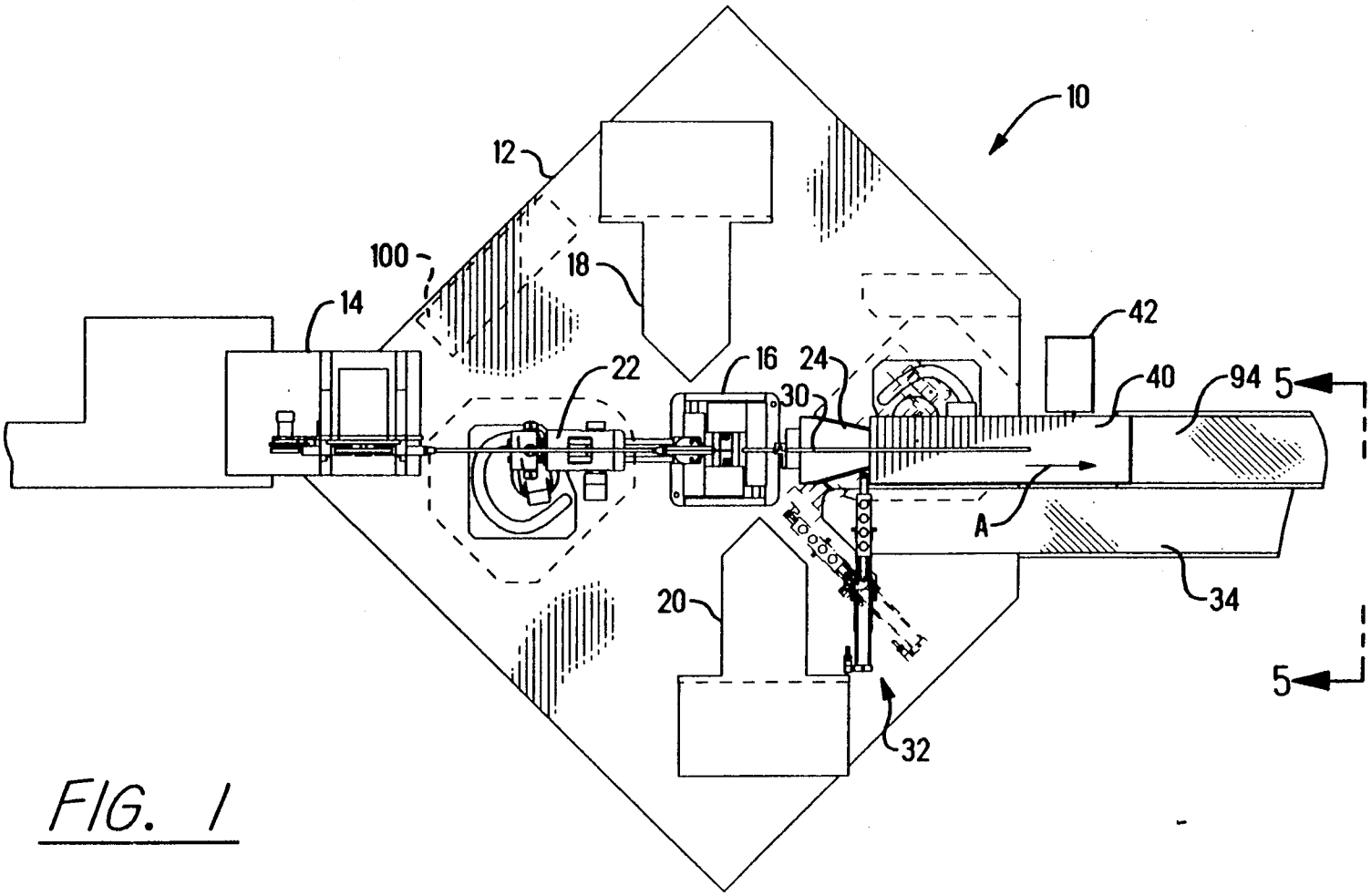
FIG. 1 is a plan view of an automated lead making machine incorporating the teachings of the present invention.
Figure 2:
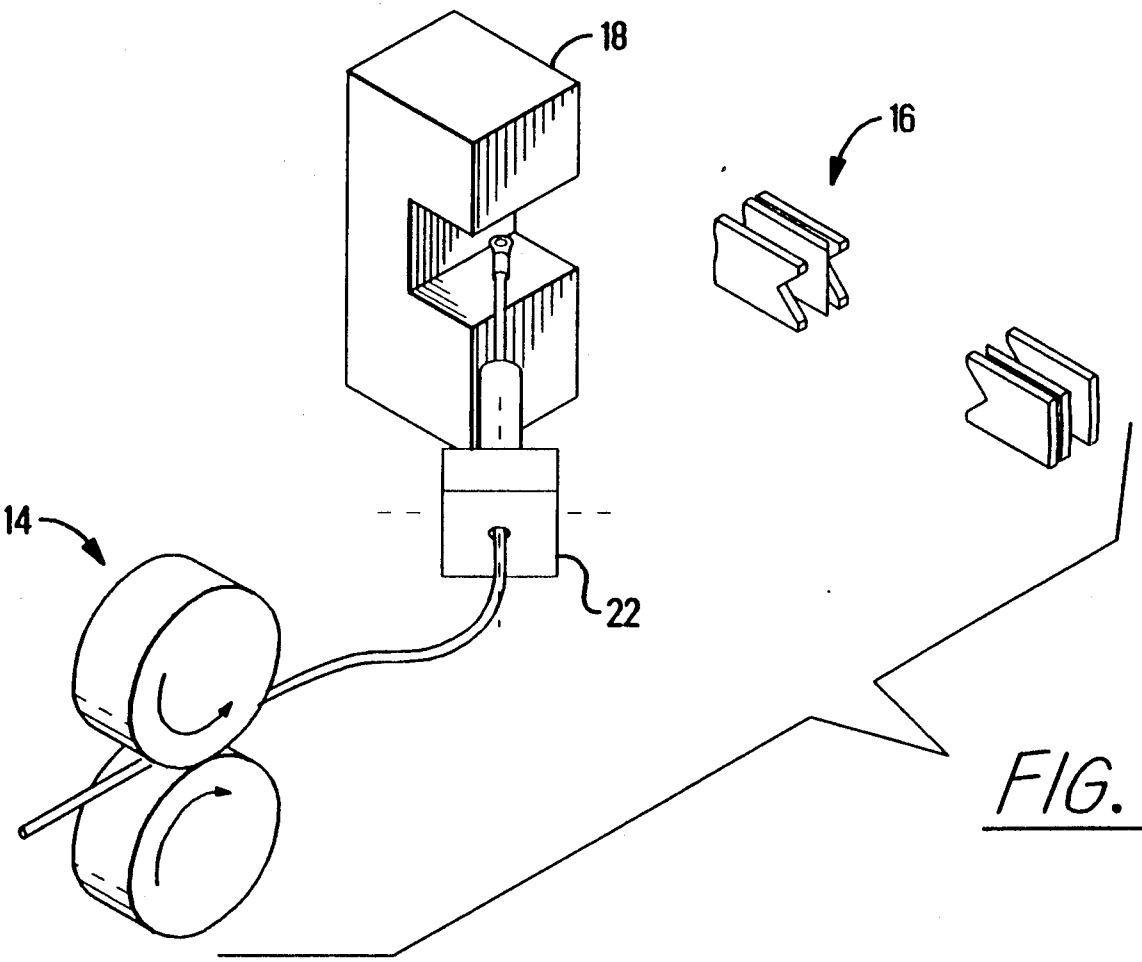
FIGS. 2, 3 and 4 are schematic diagrams depicting the operation of the machine.
Figure 5:
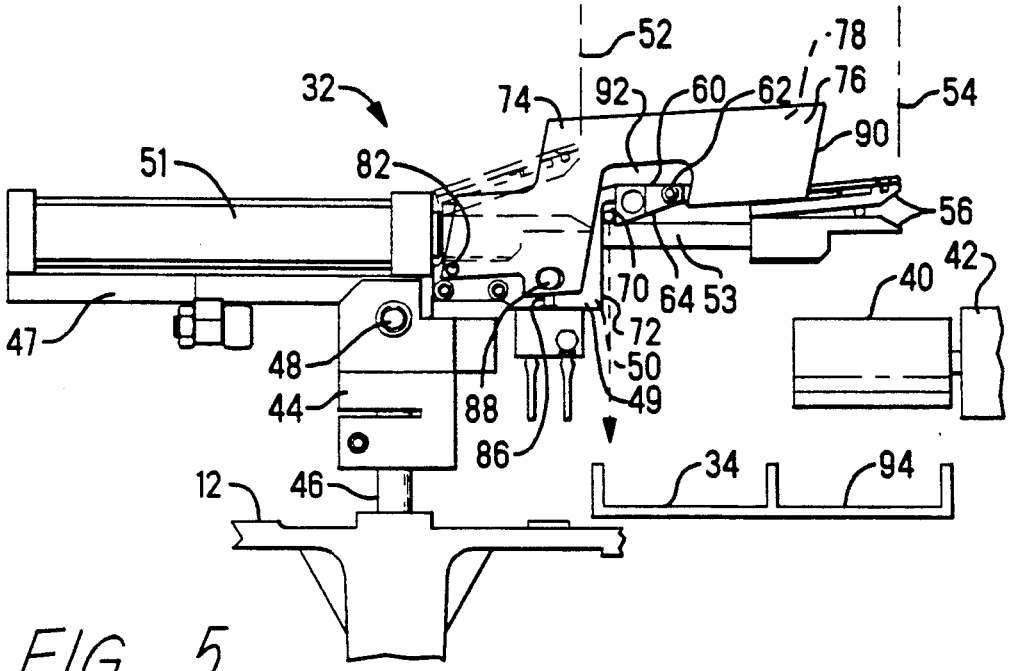
FIG. 5 is a side view of the wire transport mechanism showing the gate open.
Figure 6:
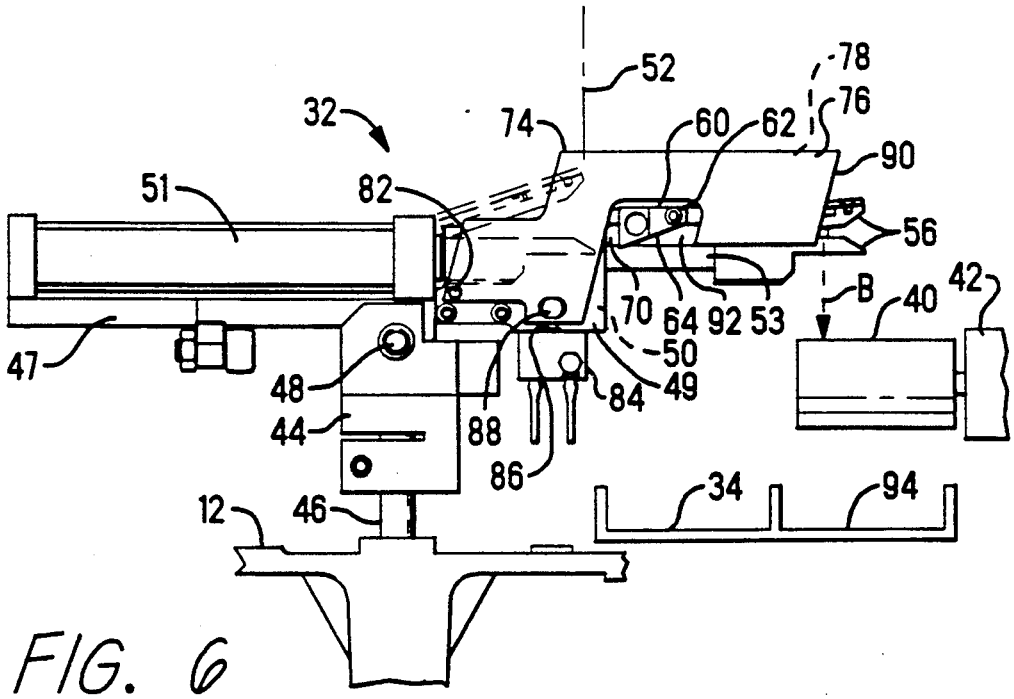
FIG. 6 is a view similar to that of FIG. 5 showing the gate closed.
Figure 7:
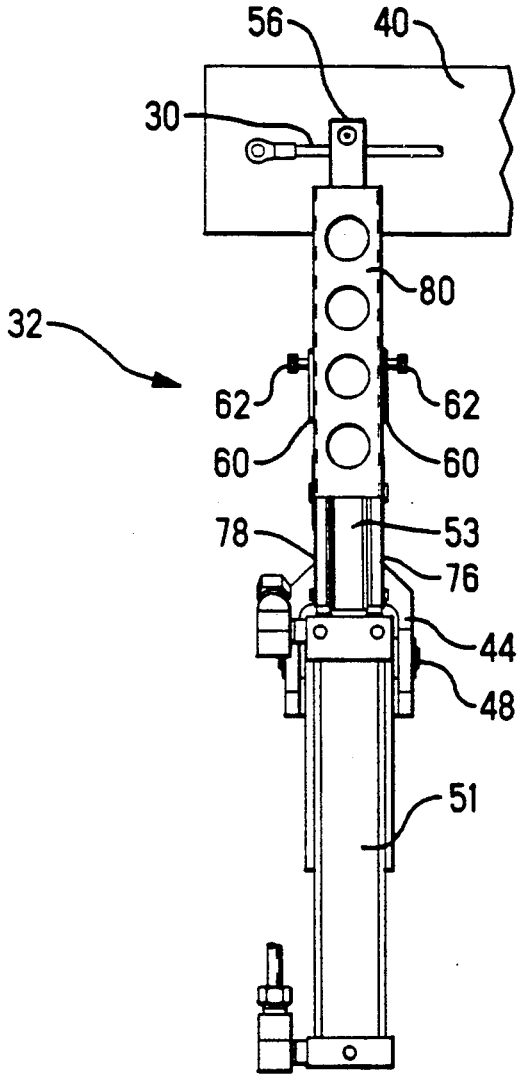
FIG. 7 is a top view of the wire transport mechanism shown in FIGS. 5 and 6.

A belt conveyor 40 is driven by a motor 42 so that the belt moves in a direction indicated by the arrow A in FIG. 1. This belt conveyor 40 has two purposes as will be described below. FIGS. 5, 6 and 7 show details of the wire transport means 32 having a mounting bracket or frame 44 pivotally mounted to the top plate 12 by means of the shaft 46. The shaft 46 permits pivotal motion of the transport means 32 back and forth between its first and second positions. A pivot plate 47 is pivotally attached to the bracket 44 by means of the pin 48 which is arranged normal to the shaft 46. A pair of side members 49 and 50 are attached to and pivot with the plate 47. An air cylinder 51 having a piston rod 53 is mounted to the plate 47 as shown in FIGS. 5, 6 and 7. A pair of wire gripping jaws 56 are mounted to the end of the piston rod 53 as shown in FIG. 5. The piston rod 53 is arranged to move the gripping jaws 56 from a retracted position at a first station shown in phantom lines at 52 in FIG. 5 along a wire path to an extended position at a second station shown in solid lines at 54. When the gripper jaws 56 are moved to their retracted position camming surfaces associated with the side members 49 and 50 are engaged by the jaws 56 causing the jaws to open as shown in phantom lines in FIG. 5. A latch 60 is pivotally mounted to the side members 49 and 50 at the point 62 as shown in FIGS. 5, 6 and 7. A torsion spring, not shown, is arranged to urge the latch counterclockwise to the position shown in FIGS. 5 and 6. An angled camming surface 64 is disposed on the underside of the latch 60 which crosses the wire path so that, as the gripper jaws 56 move the lead 30 toward the retracted position at 52, the lead 30 engages this surface 64 causing the latch to pivot clockwise. As the lead 30 passes, the latch is returned to its position shown in FIG. 5 with the lead trapped in a channel 70 formed by the latch 60 and wire abutting surfaces 72 on the side members 49 and 50. As the gripper jaws 56 continue to move toward the retracted position, the lead 30 abuts the surface 72 and is held there until the gripper jaws 56 have completely retracted to the position shown at 52 in FIG. 5. Due to the dynamic characteristics of a laterally moving wire being suddenly stopped against the abutting surface 72, the wire tends to rebound unpredictably. The purpose of the latch 60 is to create the channel 70 which confines and controls this rebound movement and acts as a dampener means allowing the lead 30 to fall substantially straight down into the tray 34 located at a first station.

A gate member 74 includes a pair of substantially parallel side plates 76 and 78 spaced apart to loosely receive the slide 48 therebetween. The side plates 76 and 78 are joined by a top plate 80 to form a structure having a U-shaped cross section. The gate member 74 is pivotally attached to the side members 49 and 50 at 82 by any suitable means. An air cylinder 84 is mounted to the side members 49 and 50 and has its piston rod 86 coupled to the gate member 74 by means of the pin 88. The air cylinder 84 is arranged to pivot the gate member 74 from a first position substantially clear of the wire path, as shown in FIG. 5 to a second position where a stop surface 90 of the gate member 74 crosses the wire path, as shown in FIG. 6. A cutout 92 is formed in both side plates 76 and 78 to clear the dampener 60,62. When the gate member 74 is in its second position, as shown in FIG. 6, the wire path is blocked so that when the gripper jaws 56 move toward their retracted position at 52, the lead 30 engages the stop surface 90 until the gripper jaws 56 proceed past that point thereby disengaging from the lead 30 which drops down onto the belt conveyor 40 as indicated by the arrow B in FIG. 6. The conveyor belt 40 then carries the lead 30 to the end of the conveyor where the lead drops into a tray 94 at a second station. The conveyor 40, while not essential to the practice of the present invention, does serve two useful purposes. One purpose is to direct wire leads to the tray 94 when the gate member 74 blocks the wire path. The other purpose is to pick up the loose first end of the lead, in the case of a long lead, and urge it outwardly to prevent entanglement with other parts of the machine.

A crimp quality monitor 100 is located within the electrical cabinet of the machine 10 adjacent the press 18 and is shown in dashed lines since it is below the surface of the top plate 12. The crimp quality monitor 100 is fully described in the '036 patent application . referenced above, and therefore, will not be described in detail here. Briefly, the crimp quality monitor 100 has sensors that attach to the terminal applicators of the presses 18 and 20 and collect force and ram position data which is analyzed by a dedicated computer to determine whether an attachment of a terminal onto a wire lead is defective or not. When the attachment is approaching its dimensioned tolerance limits the applicator can be automatically adjusted to bring the dimension back closer to the norm. Additionally, the crimp quality monitor will generate a reject signal if the attachment is deemed to be out of tolerance and the lead unusable.

In the present invention, such a reject signal is used to cause the cylinder 84 to pivot the gate member 74 to its second position so that the surface 90 blocks the wire path. In this case, the defective wire lead 30 is dropped onto the conveyor 40 and is deposited in the tray 94. In the case where the attachment is not defective, the computer signals the cylinder 84 to pivot the gate member 74 to its first position clear of the wire path as shown in FIG. 5. In this case the lead 30 is moved into the channel 70 where the lead is removed from the gripper jaws 56, as the gripper retracts, and drops into the lead stacking tray 34. Thus, the crimp quality monitor 100, gate member 74, and cylinder 84 effectively sort leads having defective terminal attachments from those leads that are not defective.

An important advantage of the present invention is that leads having defective terminal attachments are automatically identified and removed immediately after the defective lead is fabricated and before the next lead is made. This is done without the need for an additional machine cycle thereby not adversely affecting, machine speed. Since the defective lead is never allowed to be commingled with high quality leads, there is little chance that a defective lead will inadvertently be included in an end product. Additionally, reliability of the manufacturing operation is enhanced because the subjective element associated with operator evaluation is completely eliminated.

I claim:

1. In an automated machine for making electrical leads having means for cutting a lead of desired length from a supply of wire and for preparing the ends of said lead, press means for attaching a terminal to an end of said lead, and monitor means for determining the quality of attachment of said terminal to said end of said lead and to identify a defective attachment, sorting means responsive to said monitor for directing said lead into a first station if not defective and into a second station if defective comprising:

(a) lead transport means having a frame and a gripper movable with respect to said frame for gripping said lead and moving it along a wire path between said first and second stations; and (b) gate means for causing said lead transport means to deposit said lead in said second station by blocking said wire path comprising:

a gate member having a first position substantially clear of said path and a second position across said path so that when in said second position and said lead transport means moves along said path toward said first station, said lead abuts said gate member and is thereby released by said lead transport means and is deposited in said second station.

2. In an automated machine for making electrical leads having means for cutting a lead of desired length from a supply of wire and for preparing the ends of said lead, press means for attaching a terminal to an end of said lead, and monitor means for determining the quality of attachment of said terminal to said end of said lead and to identify a defective attachment, sorting means responsive to said monitor for directing said lead into a first station if not defective and into a second station if defective comprising:

(a) conveyor means for moving said lead to one of said first and second stations;

(b) lead transport means having a frame and a gripper movable with respect to said frame for gripping said lead and moving it to said conveyor means and for moving it along a path to the other of said first and second station; and (c) selectively movable gate means for abutting said lead and causing said lead transport means to deposit said lead onto said conveyor means or into the other of said first and second stations in response to the determined quality of the attachment and whether or not it is identified as defective.

3. The apparatus according to claim 2 wherein said conveyor means moves said lead to only said second station and said lead transport means moves said lead to said first station.

4. The apparatus according to claim 1 wherein said gate member is pivotally attached to said frame so that said gate member pivots from said first position to said second position, and said gate means includes an actuator for effecting said pivotal movement.

5. The apparatus according to claim 4 wherein said actuator is responsive to said monitor means so that when said lead is identified as having a defective attachment, said gate member is pivoted to said second position.

6. The apparatus according to claim 1 wherein said gate means includes an actuator arranged to move said gate member to said second position in response to said monitor means identifying said lead as having a defective attachment.

7. The apparatus according to claim 6 including a tray at said first station and wherein said gate means is arranged so that when said member is in said first position said lead gripper moves said lead along said path to said first station and deposits said lead into said tray.

8. The apparatus according to claim 7 including dampener means for receiving said lead from said lead gripper and for dampening movement of said lead prior to depositing into said tray.

9. The apparatus according to claim 8 wherein said dampener means comprises:

(a) an abutting surface associated with said frame;

(b) a latch pivotally attached to said frame and positioned adjacent said abutting surface to form a channel sized to receive said lead, said latch having a camming surface across said path so that as said lead is moved along said path, said lead engage said camming surface and causes said latch to pivot allowing said lead to enter said channel.

10. The apparatus according to claim 3 wherein said gate means comprises a gate member having a first position substantially clear of said path and a second position across aid path so that when in said second position and said lead transport means moves along said path toward said first station, said lead abuts said gate member and is thereby released by said lead transport means and is deposited in said second station.

* * * * *